US008348418B2

(12) United States Patent
Uchino

(10) Patent No.: US 8,348,418 B2
(45) Date of Patent: Jan. 8, 2013

(54) TRANSPORTING APPARATUS AND PRINTER USING THE SAME

(75) Inventor: Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 164 days.

(21) Appl. No.: 13/033,442

(22) Filed: Feb. 23, 2011

(65) Prior Publication Data

US 2011/0292147 A1 Dec. 1, 2011

(30) Foreign Application Priority Data

May 31, 2010 (JP) ..... 2010-125226

(51) Int. Cl.
*B41J 2/01* (2006.01)

(52) U.S. Cl. ..... 347/104

(58) Field of Classification Search ..... None
See application file for complete search history.

(56) References Cited

FOREIGN PATENT DOCUMENTS

JP H06-063538 U 9/1994
JP H09-034202 A 2/1997

*Primary Examiner* — Stephen Meier
*Assistant Examiner* — Tracey McMillion
(74) *Attorney, Agent, or Firm* — Baker Botts L.L.P.

(57) ABSTRACT

There is provided a transporting apparatus which includes a pair of transporting rollers including drive and driven rollers; a transporting path including a curved portion which changes a transporting direction of the transporting medium; a movable member which is changeable to a first attitude forming an outer side of the curved portion to guide the transporting medium, and a second attitude opening the curved portion not to form the outer side of the curved portion. The movable member has a guiding portion which guides the transporting medium between the pair of transporting rollers, in the first attitude, and a positioning portion which positions the guiding portion with respect to a shaft of the drive roller in the first attitude, and which is separated from the shaft of the drive roller in the second attitude.

11 Claims, 8 Drawing Sheets

REAR
FRONT
RIGHT
LEFT
UP
DOWN
V
50
51
52
52A
52B
53
54
54A
54B
56
7
8
9

TRANSPORTING APPARATUS AND PRINTER USING THE SAME

CROSS REFERENCE TO RELATED APPLICATION

The present application claims priority from Japanese Patent Application No. 2010-125226, filed on May 31, 2010, the disclosure of which is incorporated herein by reference in its entirety.

BACKGROUND OF THE INVENTION

1. Field of the Invention

The present invention relates to a transporting apparatus in which a guiding portion which guides a medium to be transported (hereinafter, 'transporting medium') between a pair of transporting rollers which transports by pinching the sheet shaped transporting medium is provided to a movable member, and a printer using the transporting apparatus.

2. Description of the Related Art

A transporting apparatus which includes a pair of transporting rollers which transports by pinching a sheet shaped transporting medium such as a recording paper, a card, and a sealed cover, and a transporting path through which the transporting medium passes, has hitherto been provided. The transporting apparatus is used in equipments such as an image recording apparatus which includes a recording section which records an image on a transporting medium which is transported, and a scanner which includes a scanning section which captures an image by scanning the transporting medium that is transported.

In the abovementioned transporting apparatus, sometimes the transporting path includes a curved portion (a bent portion) which changes a transporting direction of the transporting medium. Such transporting apparatus has been used in equipments such as an image recording apparatus and a scanner in which a recording section or a scanning section, and a mounting section on which the transporting medium is placed are arranged vertically. The transporting apparatus transports the transporting medium placed on the mounting section to the recording section or the scanning section which is arranged at an upper side or at a lower side of the mounting section so that the transporting direction of the transporting medium is changed in the curved portion.

In Japanese Patent Application Laid-open No. H09-34202, a transporting apparatus in which an opening is formed on an outer wall of a casing of the transporting apparatus and a movable member is openably installed on the outer wall of the casing, and the movable member is provided with a guiding portion which defines an outer side of a curve of the abovementioned curved portion has been disclosed.

The transporting apparatus includes the casing, the mounting section which is accommodated at a lower portion of the casing, a feeding section which sends rearward the transporting medium placed on the mounting section, a transporting path which has a curved portion (bent portion) which changes the transporting direction of the transporting medium sent rearward by the feeding portion, to frontward (direction), a recording section which is arranged at an upper side of the mounting section and which records an image on the transporting medium of which the transporting direction has been changed, and a movable member which is openably installed on a rear wall of the casing provided with the opening. The movable member is provided with the guiding portion which defines an outer side of the curve of the curved portion. Since the movable member is provided with the guiding portion, it is possible to expose the transporting path to outside of the casing by opening the movable portion.

SUMMARY OF THE INVENTION

In the transporting apparatus having the curved portion as mentioned above, transporting the transporting medium assuredly by reducing an effect of a frictional force between the transporting medium and the curved portion by providing a pair of transporting rollers in the curved portion is considered. When the pair of transporting rollers is arranged in the curved portion, the transporting medium is guided to a nipping position which is located between the pair of transporting rollers, by the guiding portion of the movable member. However, in the guiding portion provided to the movable member, an accuracy of position with respect to the nipping position is poor (not favorable), and there is a possibility that the transporting medium hits the pair of transporting roller and is dented.

When the guiding portion is brought closer to the nipping position, it is possible to reduce a shift in position of the transporting medium which is transported and the nipping position. However, when the guiding portion is brought excessively closer to the nipping position, while the transporting medium passes through the pair of transporting rollers, the transporting medium bent in the curved portion is pressed strongly against the guiding portion, and the frictional force between the transporting medium and the guiding portion becomes substantial, thereby hindering the transporting of the transporting medium and leaving a scratch on a surface of the transporting medium by the guiding portion.

As it has been described above, when the pair of transporting rollers is provided at an upstream side of the curved portion in the transporting apparatus having the guiding portion provided to the movable member, which forms an outer side of the curved portion, due to poor accuracy of relative positions of the guiding portion and the nipping position of the pair of transporting rollers, hindering of transportation of the transporting medium is anticipated.

The present invention has been made in view of the abovementioned problems, and an object of the present invention is to provide a transporting apparatus in which it is possible to improve an accuracy of relative positions of the guiding portion provided to the movable member, and the nipping position of the pair of transporting rollers.

According to a first aspect of the present invention, there is provided a transporting apparatus which transports a sheet shaped transporting medium, including:

a pair of transporting rollers which pinches the transporting medium to transport, including a drive roller and a driven roller which is driven by the drive roller;

a transporting path which is formed to have a curved portion which changes a transporting direction of the transporting medium transported by the pair of transporting rollers, and the pair of transporting rollers being arranged in the curved portion; and a movable member which is changeable to a first attitude and a second attitude, wherein under a condition that the movable member takes the first attitude, an outer side of the curved portion is defined by the movable member to guide the transporting medium, under a condition that the movable member takes the second attitude, the outer side of the curved portion is opened not to define the outer side of the curved portion, and the movable member includes a guiding portion which guides the transporting medium between the pair of transporting rollers under a condition that the movable member takes the first attitude, and a positioning portion which positions the guiding portion with respect to a shaft of the drive roller under a condition that the movable member takes the first attitude, and which is separated from the shaft of the drive roller under a condition that the movable member takes the second attitude.

The guiding portion is positioned with respect to the shaft of the drive roller by the positioning portion. Therefore, it is possible to improve an accuracy of relative positions of the guiding portion and the nipping position of the pair of transporting rollers. As a result, it is possible to realize a transporting apparatus which is capable of transporting the transporting medium with normalcy even when a radius of curvature of the curved portion is made small, and a transporting apparatus which is capable of transporting the transporting medium with normalcy irrespective of the type of the transporting medium.

According to a second aspect of the present invention, there is provided a printer which jets an ink on to a sheet shaped recording medium to form an image, including:

a recording-medium supply section on which the recording medium is placed;

a recording head which jets the ink onto the recording medium; and the transporting apparatus according to the first aspect of the invention, which transports the recording medium placed on the recording-medium supply section, toward the recording head.

According to the present invention, it is possible to improve an accuracy of relative positions of the nipping position of the pair of transporting rollers and the guiding portion provided to the movable member, and it is possible to prevent the recording medium from hitting against the transporting roller, and from pressing hard against the guiding portion.

BRIEF DESCRIPTION OF THE DRAWINGS

FIG. 4A is a plan view, FIG. 4B is a front view, FIG. 4C is a left side view, and FIG. 4D is a right side view;

DETAILED DESCRIPTION OF THE PREFERRED EMBODIMENTS

Figure 1:
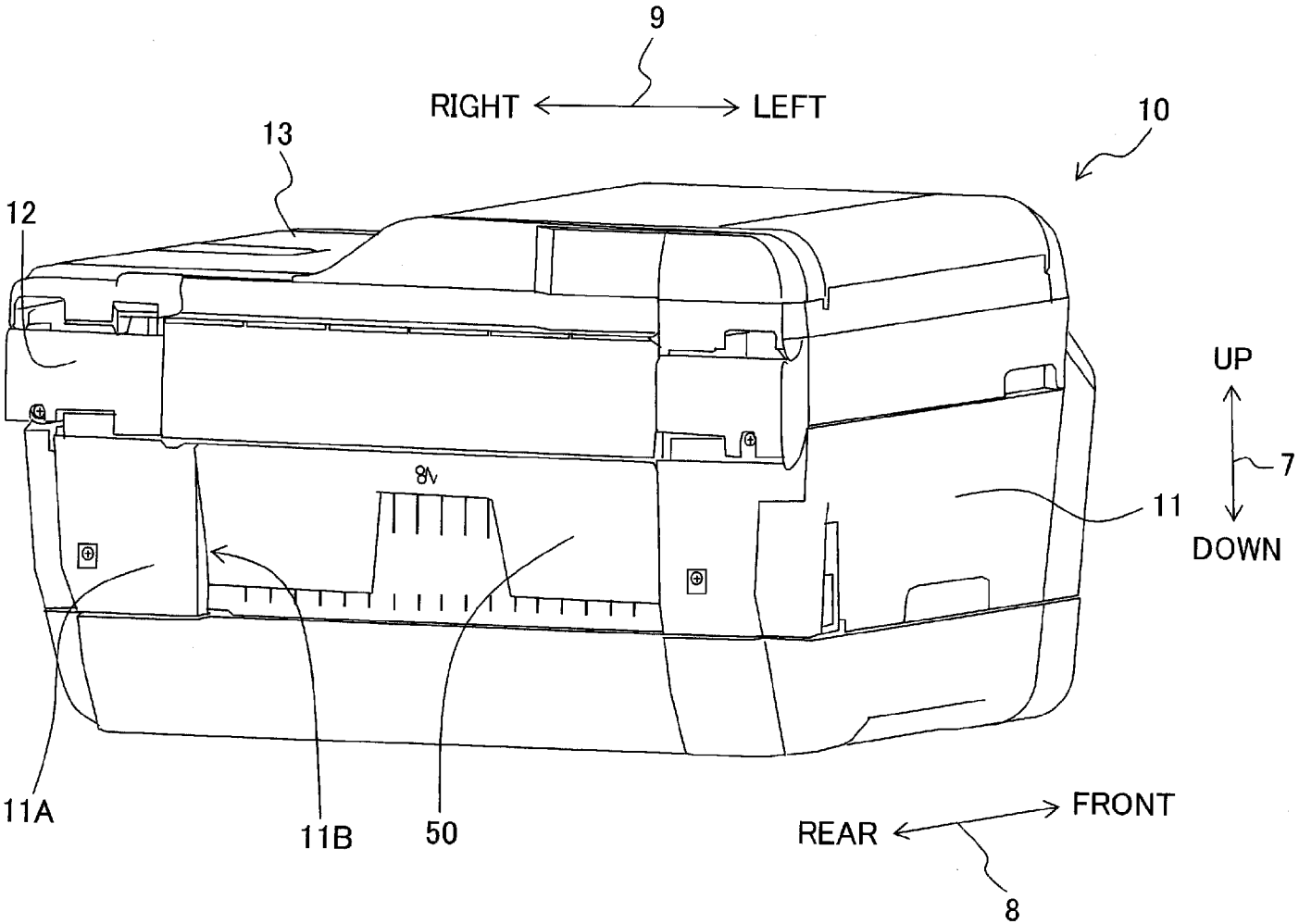
FIG. 1 is a perspective view of a rear side of a multi function device in which a movable member is in a state in a first attitude of being closed.

A preferable embodiment of a transporting unit 30 according to the present teaching will be described below. Concretely, the transporting unit 30 according to the present teaching is used in a printer section 15 of FIG. 3 included in a multi function device 10 in FIG. 1 having functions such as printing, scanning, copying, and facsimile. As shown in FIG. 1, in the present patent specification, a height direction of the multi function device 10 is defined as a vertical direction 7, and a depth direction of the multifunction device 30 is defined as a front-rear direction 8, and a width direction of the multifunction device 30 is defined as a left-right direction 9.

Figure 3:
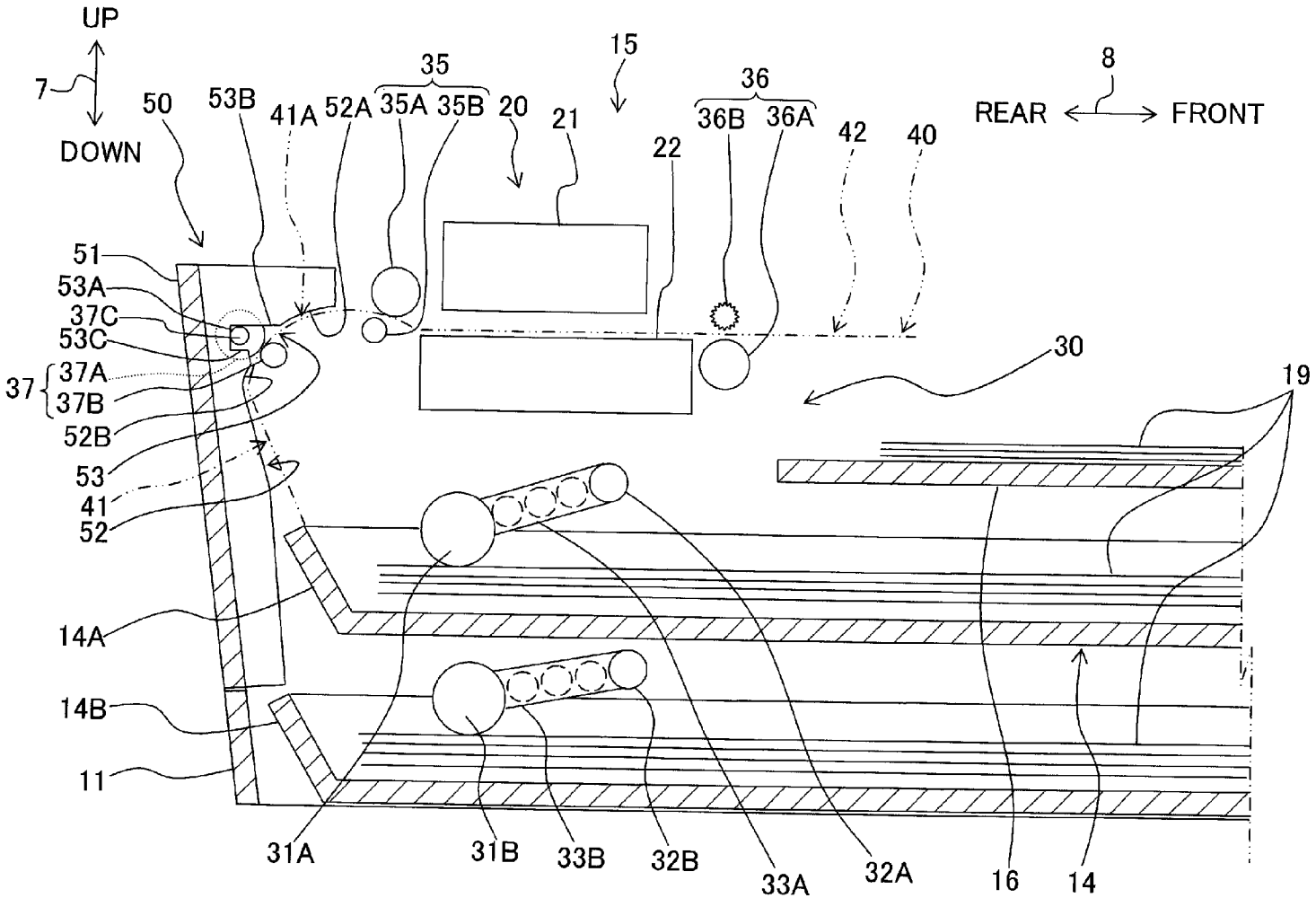
FIG. 3 is a schematic cross-sectional view of a printer section.

The multifunction device 10, as shown in FIG. 1, includes a printer casing 11, a scanner casing 12 which is arranged at an upper side of the printer casing 11, and a document cover 13 which is arranged at an upper side of the scanner casing 12. A paper feeding cassette 14 in which a transporting medium 19 in the form of a flexible sheet, such as a recording paper, a card, and an envelope, is to be placed, is slidably accommodated in a lower portion of the printer casing 11 as shown in FIG. 3. The printer section 15 which records an image on the transporting medium 19 placed in the paper feeding cassette 14 is accommodated in an upper portion of the printer casing. Moreover, the printer casing 11 supports at an upper side of the paper feeding cassette 14, a discharge paper tray 16 to which the transporting medium 19 upon recording of an image is discharged.

As shown in FIG. 1, an opening 11B for exposing to an outside the printer section 15 accommodated in the printer casing 11 is formed in a rear wall 11A of the printer casing 11. The side wall 11A openably supports a movable member 50 which will be described later. The movable member 50 is to be opened by a user when the paper jam occurs.

The scanner casing 12 is openably supported by the printer casing 11, and openably supports the document cover 13. The scanner casing 12 fixes a document from which an image is scanned or captured, by sandwiching together with the document cover 13. A scanner section which is not shown in the diagram, such as a flat-bed scanner which fetches by scanning an image on a document, is accommodated in the scanner casing 12. A control of the scanner section and the printer section 15 is carried out by a control section. The control section is realized by various electronic components such as a microcomputer, mounted on a control circuit board.

A control signal which is inputted from an input switch provided to an operation panel (not shown) installed on a front-surface side of the printer casing 11, or is inputted from an external equipment such as a personal computer (not shown) is inputted to the control section. The control section carries out scanning of an image or a recording of an image according to the signal which has been inputted. Concretely, the control section carries out control of the scanner, a recording section 20 that will be described later, and a drive motor. The printer section 15 which carries out recording of an image will be described below.

As shown in FIG. 3, the printer section 15 includes the transporting unit 30 which transports the transporting medium 19 placed on the paper feeding cassette 14, the recording section 20 which records an image on the transporting medium 19 transported by the transporting unit 30, and a drive section which drives objects to be driven such as a recording head 21 that is provided to the recording section 20 and will be described later, drive rollers 35A, 36A, and 37A, and paper feeding rollers 31A and 31B in the transporting unit 30 that will be described later. The drive section includes a plurality of drive motors which are controlled and driven by the control section, and a drive transmission mechanism which transmits a driving force of the drive motor to components such as the recording head 21.

The recording section 20 includes a platen 22 in the form of a plate which is arranged at an upper side of a rear portion of the paper feeding cassette 14 installed in the printer casing 11, the recording head 21 which is arranged to be facing the platen 22 at an upper side of the platen 22, and a rail which is not shown in the diagram and which movably supports the recording head 21 in the left-right direction 9.

A plurality of nozzles which are not shown in the diagram, is formed in the recording head 21 of the recording section 20. A jetting port of each nozzle opens downward. When a pressure is applied to the ink due to a deformation of a piezoelectric element, ink droplets are jetted from the jetting ports toward the platen 22 located below. Moreover, the recording head 21 moves in the left-right direction 9 by the above mentioned drive section. As it will be described later, the transporting medium 19 is transported in a front direction on the platen 22 by the transporting unit 30. In such manner, since the transporting medium 19 is transported frontward and the recording head 21 moves in the left-right direction 9, the recording head 21 can record an image almost on an entire front surface of the transporting medium 19.

The paper feeding cassette 14 on which the transporting medium 19 is placed includes two trays 14A and 14B, each formed to be box-shaped and opening upward, as shown in FIG. 3. The trays 14A and 14B are arranged vertically. A rear wall of the trays 14A and 14B is formed to be extended rearward and inclined upward from a rear end of a bottom of the trays 14A and 14B. The transporting medium 19 placed either on the tray 14A or the tray 14B is sent rearward in an inclined upward direction by the side wall of either the tray 14A or the tray 14B, and by the transporting unit 30 that will be described later.

The transporting unit 30 includes a paper feeding roller 31A which sends the transporting medium 19 placed on the tray 14A, a paper feeding roller 31B which sends the transporting medium 19 placed on the tray 14B, a transporting path 40 through which the transporting medium 19 sent by the paper feeding rollers 31A and 31B passes, and three sets of pairs of transporting rollers 35, 36, and 37 which are attached to the transporting path 40, and which transport by pinching the transporting medium 19.

As shown in FIG. 3, the paper feeding roller 31A is arranged at an upper side of a rear portion of the tray 14A, and is pivotably supported vertically by using an arm 33A and a rotating shaft 32A driven and rotated by the abovementioned drive section. The paper feeding roller 31A is pivotably installed at one end portion of the arm 33A, and the other end portion of the arm 33A is pivotably supported by the rotating shaft 32A. The paper feeding roller 31A makes a contact with the transporting medium 19 placed in the tray 14A. The paper feeding roller 31A rotates by rotating of the rotating shaft 32A, and sends the transporting medium 19 in contact with the paper feeding roller 31A, to the transporting passage 40. The paper feeding roller 31B has a structure similar to the paper feeding roller 31A. When the paper feeding roller 31B makes a contact with the transporting medium 19 and rotates, the transporting medium 19 is sent to the transporting path 40.

As shown in FIG. 3, the transporting path 40 includes a first transporting path 41 through which the transporting medium 19 sent by the paper feeding rollers 31A and 31B passes, and a second transporting path 42 which is connected to the first transporting path 41.

As shown in FIG. 3 the first transporting path 41 includes a curved portion 41A having a circular arc shaped cross-section. One end of the first transporting path 41 is positioned at an upper side of an upper end of a rear wall of the tray 14A of the paper feeding cassette 14 installed in the printer casing 11, and the other end of the first transporting path 41 is positioned at a rear side of the rear end of the platen 22. Since it is possible to change the transporting direction of the transporting medium 19 by the curved portion 41A, it is possible to make the multi function device 10 compact.

The first transporting path 41 is formed by the movable member 50 to be described later which is positioned at an outer side of a curve of the curved portion 41A, and a guiding member not shown in the diagram which is positioned at an inner side of the curve of the curved portion 41A. The first transporting path 41 changes the transporting direction of the transporting medium 19 sent in rearward and inclined upward direction, to a frontward direction by the curved portion 41A. The first transporting path 41 corresponds to a transporting path of the present teaching, and the curved portion 41A corresponds to a curved portion of the present teaching.

The second transporting path 42, as shown in FIG. 3, is a transporting path on the platen 22, and is formed to have a linear cross-section. The second transporting path 42 is formed by the platen 22 and a guiding member not shown in the diagram. The transporting medium 19 is transported on to the second transporting path 42 by the pairs of transporting rollers 35 and 36 which will be described below, and an image is recorded thereon by the abovementioned recording section 20.

The pair of transporting rollers 35 includes a plurality of drive rollers 35A installed on a shaft along the left-right direction 9 (not shown in the diagram), and a plurality of driven rollers 35B which are driven by the drive rollers 35A. The shaft on which the drive roller 35A is installed is rotated by the abovementioned drive section. A height position of the pair of transporting rollers 35 is set so that the second transporting path 42 passes the nipping position. The pair of transporting rollers 35 transports the transporting medium 19 by pinching between the drive roller 35A and the driven roller 35B. Moreover, the pair of transporting rollers 35 is located at a position which is rearward of the platen 22 in the front-rear direction 8.

The pair of transporting rollers 36 has a structure similar to the transporting rollers 35, and includes a plurality of drive rollers 36A and a plurality of driven rollers 36B. A height position of the pair of transporting rollers 36 is set so that the second transporting path 42 passes the nipping position. The pair of transporting rollers 36 is located at a position which is frontward of the platen 22 in the front-rear direction.

The pair of transporting rollers 36 is arranged at a front side of the platen 22, and the pair of transporting rollers 35 is arranged at a rear side of the platen 22 as described above. Therefore, two ends in the front-rear direction of the transporting medium 19 on the platen 22 are supported by the pairs of transporting rollers 35 and 36. The control section controls an angle of rotation and an amount of rotation of the shaft on which the drive roller 35A is installed and the shaft on which the drive roller 36A is installed. Accordingly, a position of the transporting medium 19 on the platen 22 is controlled, and an image is recorded on the transporting medium 19.

The pair of transporting rollers 37 includes a plurality of drive rollers 37A installed on a shaft 37C along the left-right direction 9, and a plurality of driven rollers 37B which are driven by the drive rollers 37A, and is arranged in the curved portion 41A. The drive rollers 37A are separated mutually in an axial direction of the shaft 37C.

Figure 2:
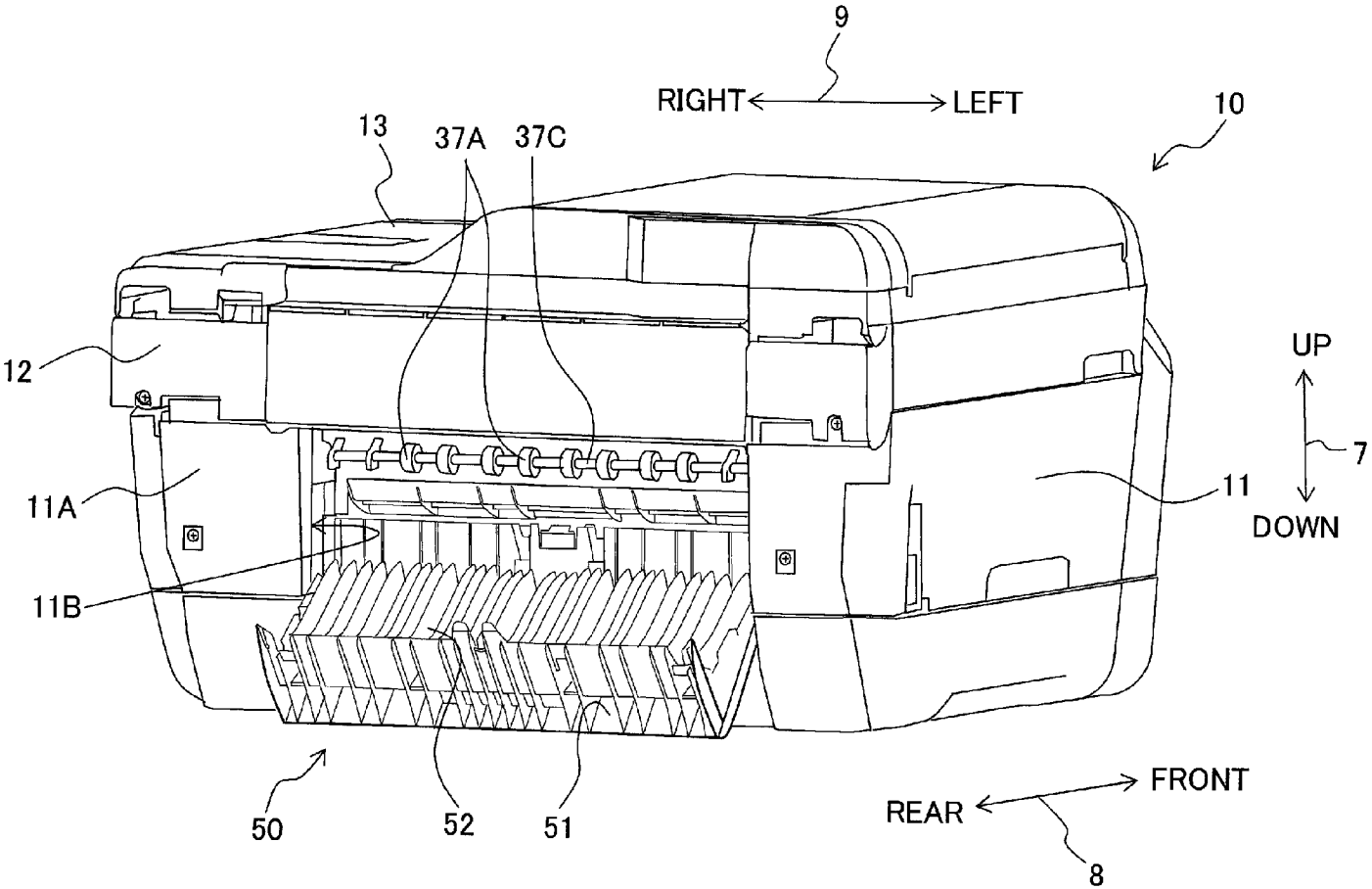
FIG. 2 is a perspective view of the rear side of the multi function device in which the movable member is in a state in a second attitude of being open.

As shown in FIG. 2, the drive roller 37A and the driven roller 37B are arranged at an outer side and an inner side respectively in a radial direction of a curve of the curved portion 41A having a circular arc shaped cross-section. The arrangement of the drive roller 37A and the driven roller 37B may be reversed. In any of the cases, the drive roller 37A and the driven roller 37B face with each other in the radial direction of the curved portion sandwiching the first transporting path 41. In other words, the pair of transporting rollers 37 is provided so that a nipping position of the pair of transporting rollers 37 is positioned at a position through which the first transporting path 41 passes. In FIG. 2, the pair of transporting rollers 37 is provided at the portion of the curved portion 41A. However, the pair of transporting rollers 37 may be provided at an upstream side of the curved portion 41A.

The shaft 37C on which the drive roller 37A is installed is driven and rotated by the drive section. The pair of transporting rollers 37 transports the transporting medium 19 by pinching between the drive roller 37A and the driven roller 37B. A force necessary for transporting is further applied to the transporting medium 19 sent by the paper feeding roller 31 by the pair of transporting rollers 37. Therefore, the transporting medium 19 is transported to pass through the curved portion resisting the gravitational force, and to reach the pair of transporting rollers 35. In such manner, in the transporting unit 30 of the embodiment, since the curved portion 41A is provided with the pair of transporting rollers 37, it is possible to apply sufficient force to the transporting medium 19, for transporting through the curved portion 41A. Therefore, even when a radius of curvature of the curved portion 41A is modified to be small, it is possible to transport the transporting medium 19, and moreover, it is also possible to transport the transporting medium 19 of a material for which a substantial frictional force is generated, and the large transporting medium 19 of a size A3. The pair of transporting rollers 37, the drive roller 37A, the driven roller 37B, and the shaft 37C correspond to the pair of transporting rollers, the drive roller, the driven roller, and the shaft respectively of the present teaching.

Incidentally, the transporting medium sent by the paper feeding rollers 31A and 31B is guided to the nipping position of the pair of transporting rollers 37 by a guide rib 52 of the movable member 50 which defines the first transporting path 41. The movable member 50 will be described below in detail.

The movable member 50 is a member formed by molding of a synthetic resin. As shown in FIGS. 4A to 4D and 5, the movable member 50 includes a base portion 51 in the form of a rectangular plate, a plurality of guide ribs 52 which are projected or protruded from a surface of the base portion 51 in a thickness direction, and a pair of engaging portions 54 which are located both sides of the one surface in left-right direction and are projected from the one surface. The movable member 50 corresponds to a movable member of the present teaching.

Figures 4A, 4B, 4C, 4D:
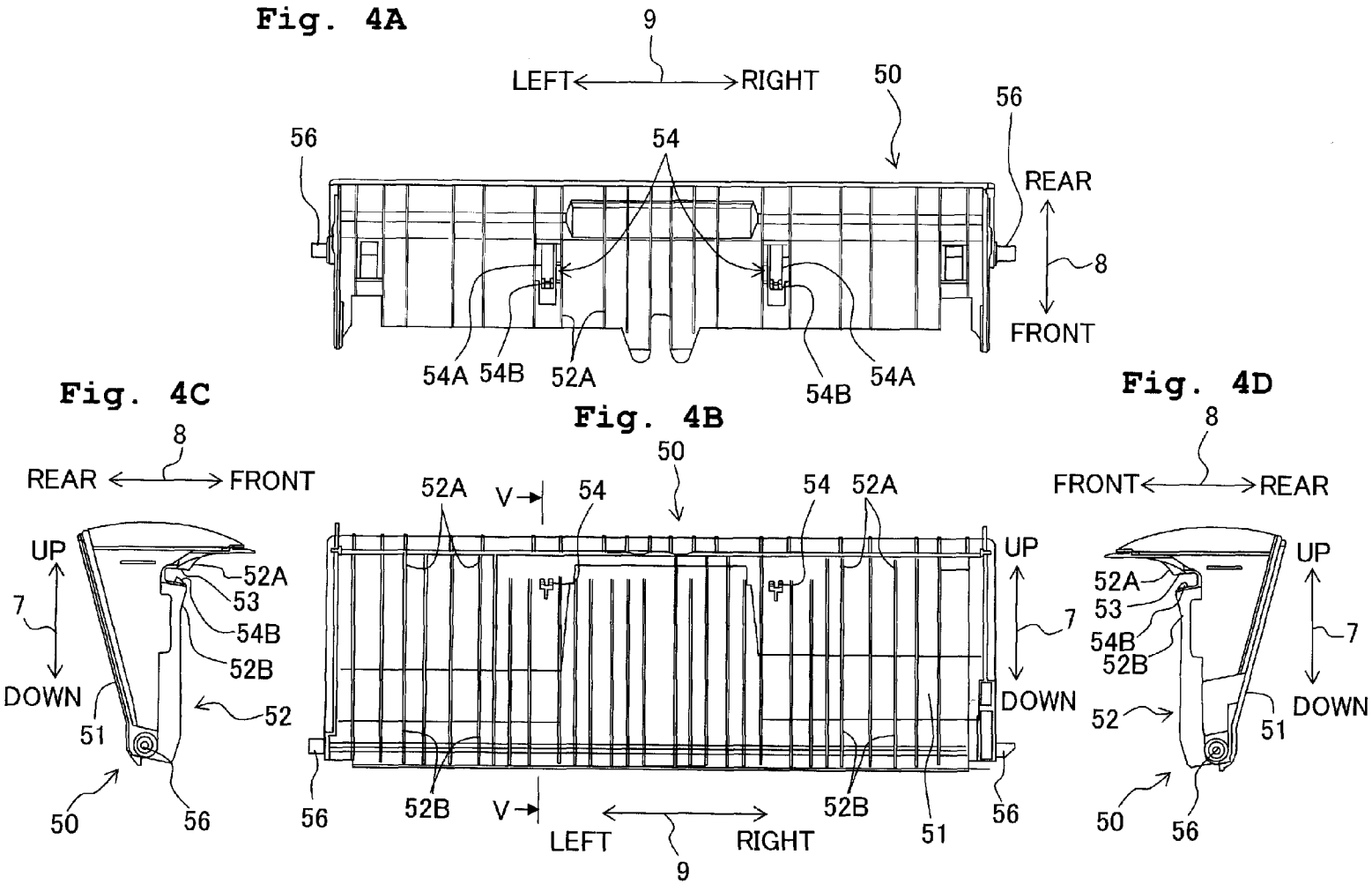
FIG. 4A, FIG. 4B, FIG. 4C, and FIG. 4D are diagrams of the movable member, where.
Figure 5:
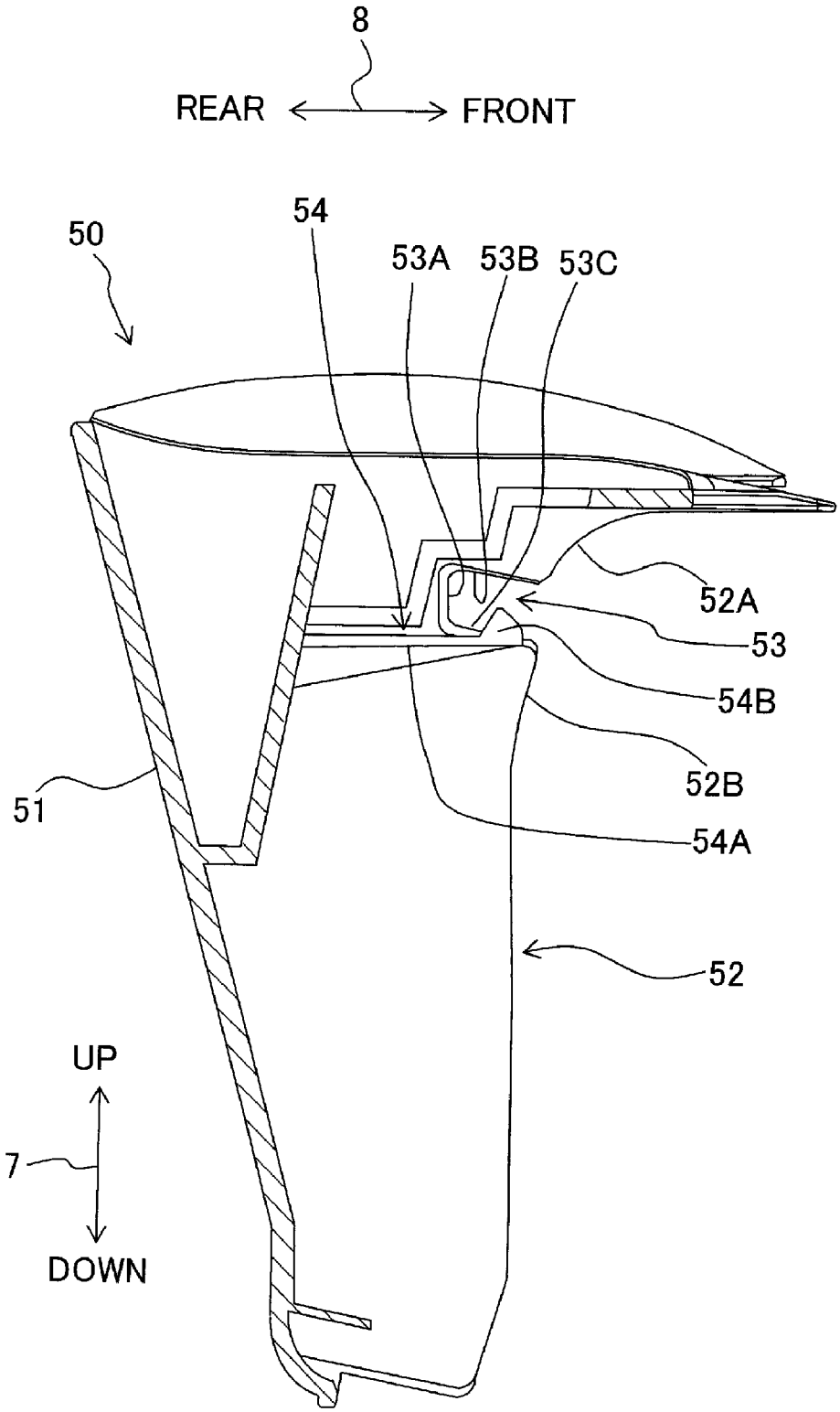
FIG. 5 is a V-V line cross-sectional view of FIG. 4B.

As shown in FIG. 4B, a pair of shaft portions 56 is protruded from the base portion 51 at a lower end portion in both side surfaces in left-right direction. The base portion 51 is openably and closably supported by the printer casing 11, between a first attitude (posture) closing the opening 11B formed in the rear wall 11A of the printer casing 11 as shown in FIG. 1, and a second attitude (posture) opening the opening 11B as shown in FIG. 2. A protrusion or a recess for placing a finger for opening the movable member 50 is provided, as an operating portion, to an upper end portion of a rear surface of the base portion 51 in the first attitude in which the movable member 50 is closed. When the movable member 50 opens the opening 11B, the first transporting path 41 is exposed to an outside of the printer casing 11. The first attitude corresponds to a first attitude of the present teaching, and the second attitude corresponds to a second attitude of the present teaching. Hereinafter, the description will be made assuming that the movable member 50 is at the first attitude in which the movable member 50 is closed unless mentioned in particular.

As shown in FIGS. 3 and 4A to 4D, the plurality of guide ribs 52 are extended in the vertical direction 7 in the first attitude, and arranged in a row in the left-right direction 9. A notch 53 in which the shaft 37C fits in the first attitude is provided in the guide rib 52, at a position near an upper end in FIG. 4C. In other words, the notch 53 is provided toward a front end portion which is away from the shaft portion 56 that is a center of the rotation of the guide rib 52, and moves in a circular arc with the shaft portion 56 as a center, by the rotation of the movable member 50, as shown in FIG. 4C.

The notch 53 is open toward the frontward direction when the movable member 50 is in the first attitude. A dimension between an upper surface 53B of the notch 53 and a lower surface 53C of the notch 53 when the movable member 50 is at the first attitude, is set to be larger than a diameter of the shaft 37C. When the attitude of the movable member 50 changes from the second attitude to the first attitude, in other words, when there is a change of the state in which the movable member 50 is opened to the state in which the movable member 50 is closed, the shaft 37C advances from a front side of the notch 53, and the shaft 37C makes a contact with an inner bottom surface 53A of the notch 53. Conversely, when the attitude of the movable member 50 changes from the first attitude to the second attitude, the notch 53 and the shaft 37C are disengaged, and the shaft 37C is withdrawn from the notch 53. In other words, the notch 53 is formed so that the shaft 37C can be fitted, and at the same time, the notch 53 is formed so that the shaft 37C can be removed. The notch 53 corresponds to a fitting portion of the present teaching.

The guide rib 52 is divided between a first portion 52A as an upper portion and a second portion 52B as a lower portion, by the abovementioned notch 53. The transporting medium 19 sent from the paper feeding cassette 14 is guided to the nipping position of the pair of transporting rollers 37 by the second portion 52B of the guide rib 52. The outer side of the curved portion 41A is defined by an upper portion of the second portion 52B of the guide rib 52, and the first portion 52A of the guide rib 52. In other words, in the embodiment, the pair of transporting rollers 37 is provided at the middle portion of the curved portion 41A. The second portion 52B of the guide rib 52 corresponds to a guiding portion and a rib of the present teaching.

Figure 6:
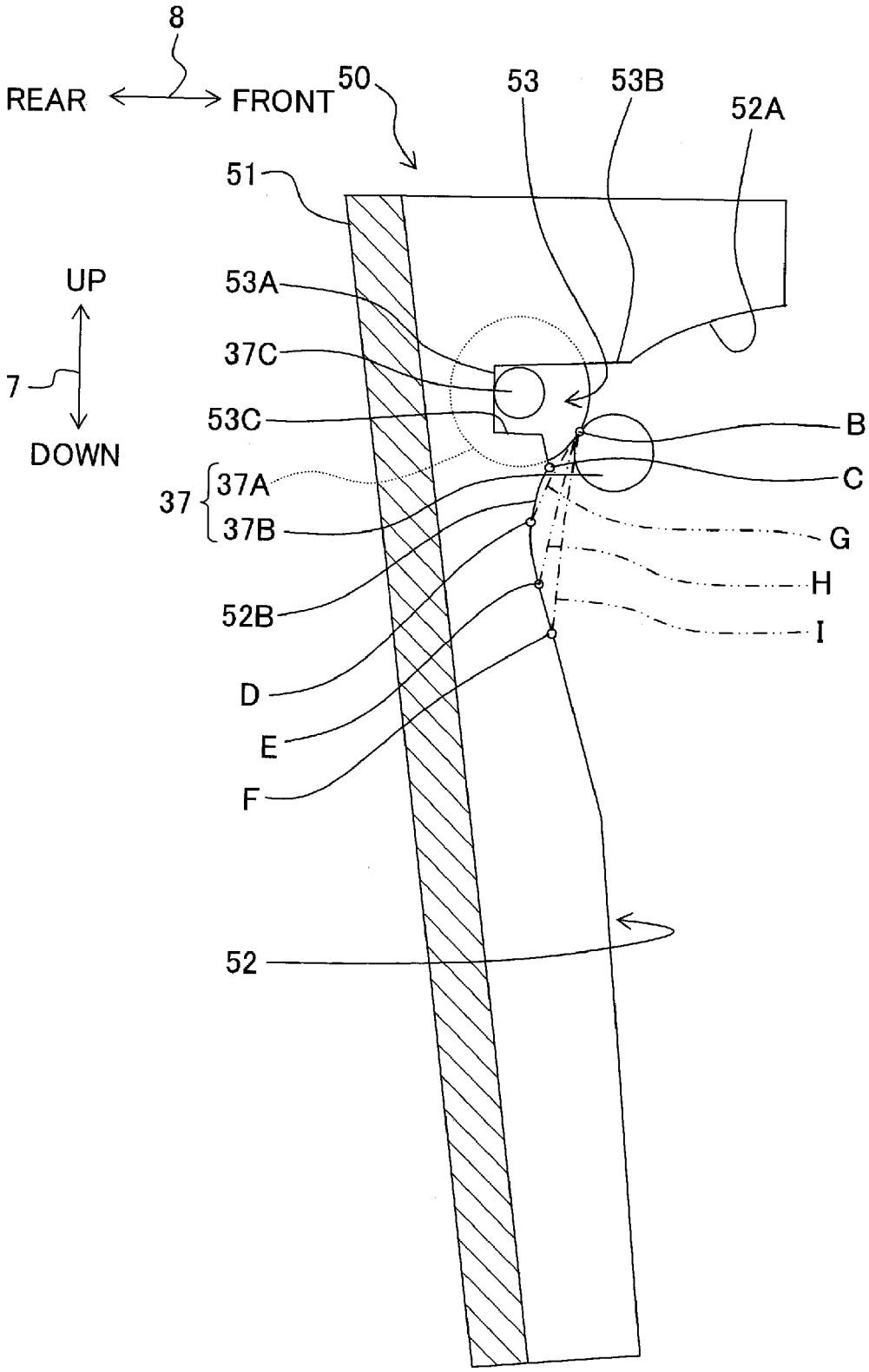
FIG. 6 is an enlarged view in which a part of FIG. 3 is enlarged.

Moreover, as shown in FIG. 6, the upper portion of the second portion 52B of the guide rib 52 forms a part of the curved portion 41A (curved-line portion). Whereas, a lower portion of the second portion 52B is formed to be linear (straight-line portion). Here, the second portion 52B of the guide rib 52 is formed so that an upper-end position C of the second portion 52B is located at a rear side of a straight line or on the straight line which is defined to be connected between an arbitrary point on a surface forming the curved surface 41A excluding the upper-end position C of the second portion 52B and a nipping position B of the pair of transporting rollers 37. For instance, in FIG. 6, the upper-end position C of the second portion 52B of the guide rib 52 is located at a rear side of the straight lines G, H, and I. The straight line G passes through point D on the surface forming the curved portion 41A of the second portion 52B and the nipping position B of the pair of transporting rollers 37. Similarly, the straight lines H and I pass through points E and F on the surface forming the curved portion 41A of the second portion 52B, and the nipping position B of the pair of transporting rollers 37, respectively. The upper-end position C is positioned at a rear side of the straight lines G, H, and I, when the transporting medium 19 passes the nipping position B. Therefore, the transporting medium 19 is lifted up from the upper portion of the second portion 52B. Therefore, it is possible to reduce a frictional force generated between the transporting medium 19 and the upper portion of the second portion 52B, and also to reduce a force with which the transporting medium 19 is pressed against the second portion 52B of the guide rib 52 at the upper-end position C. As a result, it is possible to prevent the transporting medium 19 from being scratched. Furthermore, it is possible to transport the transporting medium 19 smoothly.

The movable member 50 in the first attitude is relatively positioned with respect to the shaft 37C in a radial direction and is fixed by the notch 53 which surrounds the shaft 37C by peripheral surfaces 53A, 53B, and 53C excluding an area at a front side of the shaft 37C, and the pair of engaging portions 54 in the left-right sides which will be described later.

As shown in FIGS. 4A to 4D, and 5, the engaging portion 54 includes a base piece 54A which protrudes frontward from a front surface of the base portion 51 in the first attitude and which makes a contact from a lower side with the shaft 37C in the first attitude, and a claw portion 54B which protrudes upward in the first attitude from a front-end portion of the base piece 54A and which is snagged on the shaft 57C in the first attitude. An installing position in the left-right direction 9 of the base piece 54A is set to an intermediate position of the adjacent drive rollers 37A in the left-right direction 9. The engaging portion 54 is engaged with the shaft 37C by the claw portion 54B getting hitched on the shaft 37C, and the shaft 37C and the notch 53 are held in a position of being fitted. The engaging portion 54 corresponds to a deformable portion of the present teaching.

Next, an operation (a movement) of the movable portion 50 will be described below. As the movable portion 50 in the second attitude is closed by the user, the shaft 37C enters the notch 53 provided at a front-end portion of the movable member 50, and also the shaft 37C makes a contact with the claw portion 54B of the engaging portion 54. Since the base piece 54A of the engaging portion 54 is formed of a synthetic resin material as mentioned above, an elastic deformation is possible. Therefore, as the shaft 37C makes a contact with the claw portion 54B, the base piece 54A is bent so that a front-end portion thereof moves downward. When the front-end portion of the base piece 54A moves downward, the claw portion 54B is turned around frontward of the shaft 37C while making a sliding contact with the shaft 37C, and makes a contact with the shaft 37C from the front side when the movable member 50 has reached the position of the first attitude. In other words, the claw portion 54B is hitched on the shaft 37C. In such manner, the engaging portion 54 is engaged with the shaft 37C by a so-called snap-fit.

The claw portion 54B which has hitched on the shaft 37C pinches the shaft 37C in a direction along a straight line joining a center of the drive roller 37A and a center of the driven roller 37B, together with the inner bottom surface 53A of the notch 53. On the other hand, as the claw portion 54B is hitched on the shaft 37C, the base piece 54A which has been bent, regains an original shape and makes a contact with the shaft 37C from the lower side. Accordingly, the base piece 54A pinches the shaft 37C in the transporting direction of the transporting medium 19, together with the peripheral surface 53B.

As it has been described above, when a peripheral surface of the shaft 37C is surrounded by the peripheral surface 53B and the inner bottom surface 53A of the notch 53, and the claw portion 54B and the base piece 54A of the engaging portion 54, the movable member 50 which is in the first attitude is positioned with respect to the shaft 37C in the radial direction of the shaft 37C, and latched by the shaft 37C. The notch 53 and the engaging portion 54 which carry out positioning of the movable member 50 correspond to a positioning portion of the present teaching.

Whereas, when the shaft 37C rotates, the shaft 37C makes a sliding contact with the peripheral surface 53B and the inner bottom surface 53A of the notch 53, and also makes a sliding contact with the claw portion 54B and the base piece 54A of the engaging portion 54. In other words, in the transporting unit 30 of the embodiment, it is possible to carry out positioning of the movable member 50 and locking of the movable member 50, without hindering the rotation of the shaft 37C.

When the movable member 50 in the first attitude which is closed is opened by the user, the base piece 54A is bent and the claw portion 54B is disengaged from the shaft 37C, and the movable member 50 is unlocked.

In the transporting unit 30 of the embodiment, since the movable member 50 is positioned by the shaft 37C on which the drive roller 37A has been installed, it is possible to improve the accuracy of relative positions of the nipping position B of the pair of transporting rollers 37 and the guide rib 52 of the movable member 50. Particularly, since the shaft 37C is pinched between the inner bottom surface 53A of the notch 53 and the claw portion 54B, it is possible to improve the accuracy of relative positions of the movable member 50 and the shaft 37C in the direction along the straight line joining the center of the drive roller 37A and the center of the driven roller 37B.

As it is possible to improve the accuracy of relative positions, it is possible to prevent collision of the pair of transporting rollers 37 and the transporting medium 19 sent from the paper feeding cassette 14 even without bringing the upper-end position C of the second portion 52B of the guide rib 52 closer to the nipping position B. As a result, it is possible to guide the transporting medium 19 accurately to the nipping position B in a state of the transporting medium 19 being suppressed from scraping against the guide rib 52 at the upper-end position C. As it has been mentioned above, in the multi function device 10, the force with which the transporting medium 19 is pressed against the upper end of the second portion 52B by using the shape of the second portion 52B of the guide rib 52 is relaxed, and accordingly, scratches which may be developed by the guide rib 52 are prevented effectively. In the multi function device 10 as mentioned above, even when the radius of curvature of the curved portion 41A of the first transporting path 41 is formed to be small, it is possible to transport the transporting medium 19 with normalcy upon preventing the transporting medium 19 without being scraped, and moreover, it is possible to transport the transporting medium 19 with normalcy irrespective of the type of the transporting medium 19.

Moreover, as it is possible to make the radius of curvature of the curved portion 41A small, it is possible to make the multi function device 10 compact by making small a dimension of height of the printer casing 11, or, it is possible to increase the number of transporting media 19 which can be placed on the paper feeding cassette 14 without increasing the dimension of height of the printer casing 11.

Moreover, as it is possible to transport the transporting medium 19 with normalcy irrespective of the type of the transporting medium 19, it is possible to use the transporting unit 30 of the present teaching in an image recording apparatus of an ink jet recording type in which recording of an image is possible on various recording media 19 such as a regular paper and a glossy paper, and an image recording apparatus which records an image on the transporting medium 19 of a large size such as A3 size.

Moreover, as the engaging portion 54 makes a contact with the shaft 37C from an upstream side (from a lower side) in the transporting direction of the transporting medium 19, it is possible to inhibit the movement of the movable member 50 to a downstream side (to the upper side) in the transporting direction. In other words, when the movable member 50 moves upward due to the frictional force developed between the transporting medium 19 and the movable member 50, a position shift may be occurred between the nipping position B of the pair of transporting rollers 37 and the guide rib 52. However, in the embodiment, it is possible to inhibit the upward movement of the movable member 50 by the contact between the base piece 54A and the shaft 37C, and as a result, it is possible to prevent the position shift in the transporting direction with the nipping position B.

Moreover, as shown in FIG. 3, an upper-end portion of the movable member 50 rotates around a lower-end portion thereof as a rotational axis, and the engaging portion 54 is provided to this rotatable upper-end portion of the movable member 50. Therefore, it is possible to latch the movable member 50 assuredly with the shaft 37C when the base piece 54A of the engaging portion 54 is pressed against the shaft 37C, and as a result, it is possible to prevent the movable member 50 from opening easily.

Moreover, as mentioned above, the position of the engaging portion 54 in the left-right direction 9 is set between the adjacent guide ribs 52 in the left-right direction 9. It may be considered that the shaft 37C on which the drive roller 37A has been installed is deformed by a nip pressure generated by the transporting medium 19 pinched by the pair of transporting rollers 37. However, as the engaging portion 54 hitched (snagged) on the shaft 37C at half way of the drive roller 37A where a displacement due to the deformation is small, it is possible to suppress the position shift of the movable member 50 due to the deformation of the shaft 37C, and as a result, it is possible to suppress the position shift of the guide rib 52 due to the transporting of the transporting medium 19.

As described above, as the drive roller 37A in the pair of transporting rollers 37 is arranged on the outer side (outer side of the radial direction) of the curved portion 41A, the shaft 37 which latches the movable member 50 is positioned on the outer side of the curved portion 41A, similarly as the movable member 50. Therefore, it is not necessary to latch the movable member 50 with the shaft 37C avoiding the first transporting path 41, and as a result, it is possible to simplify the structure of the movable member 50. In other words, it is possible to position the movable member 50 with respect to the shaft 37C with a simple structure of the engaging portion 54 and the notch 53. The drive roller 37A may be arranged at the inner side (inner side of the radial direction) of the curved portion 41A, and the driven roller 37B may be arranged at the outer side. In this case, the position of the engaging portion 54 in the left-right direction is set so that the claw portion 54B is hitched on the shaft 37C at both left and right end portions of the shaft 37C.

Moreover, in the embodiment, when the movable member 50 changes to the first attitude, the claw portion 54B is hitched on the shaft 37C. Therefore, it is possible to carry out an operation of opening and closing the movable member 50 and an operation of engaging and disengaging the movable member 50 with and from the shaft 37C by one operation, thereby making the multi function device 10 user-friendly. An arrangement for engaging and disengaging the claw portion 54B with and from the shaft 37C may be adopted by providing the claw portion 54B with respect to the base portion 51 so that the attitude of the claw portion 54B is variable, and by changing the attitude of the claw portion 54B by the user in a state of the movable member 50 in the first attitude.

In the embodiment, an arrangement in which the movable member 50 is opened and closed by pivotal movement has been described. An arrangement in which the movable member 50 is opened and closed by attaching and detaching by the user may be adopted, or an arrangement in which the movable member 50 is opened and closed by sliding may be adopted.

In the embodiment, the guide rib 52 has been described as an example of a guiding portion. However, the guiding portion is not restricted to the guide rib 53. For instance, a surface which defines an outer side of the first transporting path 41 may be formed on the base portion 51 to provide the guiding portion. However, in the arrangement of forming the guiding portion by a rib, it is possible to make small the frictional force generated between the transporting medium 19 and the movable member 50, and to transport the transporting medium 19 more smoothly.

Moreover, in the embodiment, an example in which the transporting unit 30 is used in the image recording apparatus has been explained. However, it is also possible to use the transporting unit 30 in a scanner apparatus. For instance, when the transporting unit 30 of the present teaching is used in the scanner apparatus in which a scanner section and a mounting section on which a document that is a transporting medium is placed, are arranged vertically (arranged at an upper level and a lower level), it is possible to make the scanner apparatus compact by making small a dimension of separation between the scanner section and the mounting section, to increase the maximum number of documents which can be placed on the mounting section without changing a dimension of height of a casing of the scanner apparatus, and to carry out sanning of an image of a document with a substantial friction and a document of a large size such as A3.

First Modified Embodiment

Figure 7:
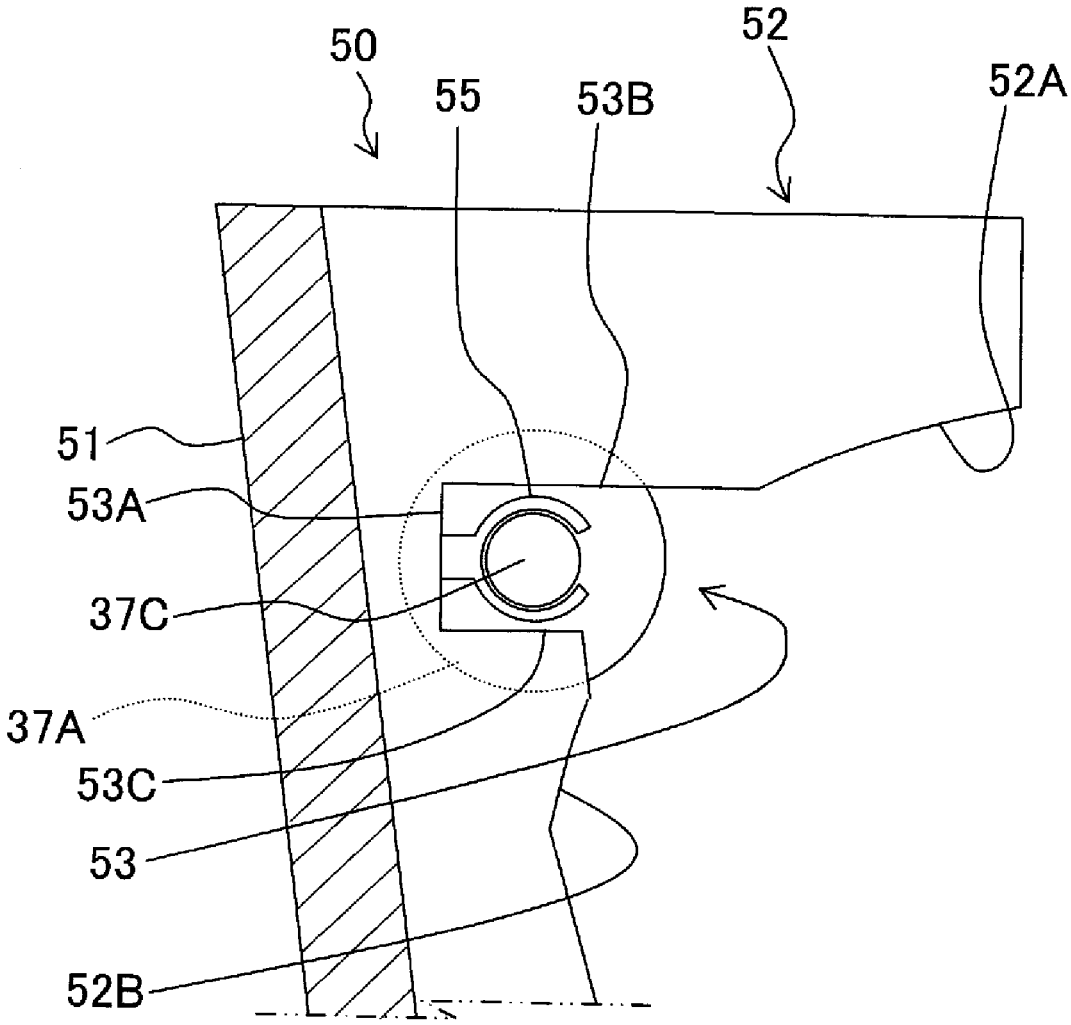
FIG. 7 is a cross-sectional view showing a movable member of a first modified embodiment.

An arrangement in which the movable member 50 is positioned by the engaging portion 54 and the notch 53 has been described above. However, in a first modified embodiment, an arrangement in which the movable member 50 is positioned by an engaging portion 55 as shown in FIG. 7 instead of the engaging portion 54 and the notch 53 will be described. The engaging portion 55 is formed to be C-shaped with a part of a ring notched out, and is provided at a position at which the shaft 37C is press-fitted when the attitude of the movable member 50 changes from the second attitude to the first attitude.

The engaging portion 55 positions the movable member 50 with respect to the shaft 37C when the peripheral surface of the shaft 37C makes a contact with an inner peripheral surface. Then the engaging portion 55 latches the movable member 50 with the shaft 37C. The rotatable shaft 37C makes a sliding contact with the inner peripheral surface of the engaging portion 55. In other words, the engaging portion 55 is capable of carrying out positioning and locking of the movable member 50 without hindering the rotation of the shaft 37C.

Second Modified Embodiment

An arrangement in which the claw portion 54B is hitched on the shaft 37C by the snap-fit has been described above. However, an arrangement in which the claw portion 54B is movably supported in the vertical direction 7 by using an elastic member such as a coil spring or a plate spring shown in FIG. 8, and the claw portion 54B is hitched on the shaft 37C may be used.

Figure 8:
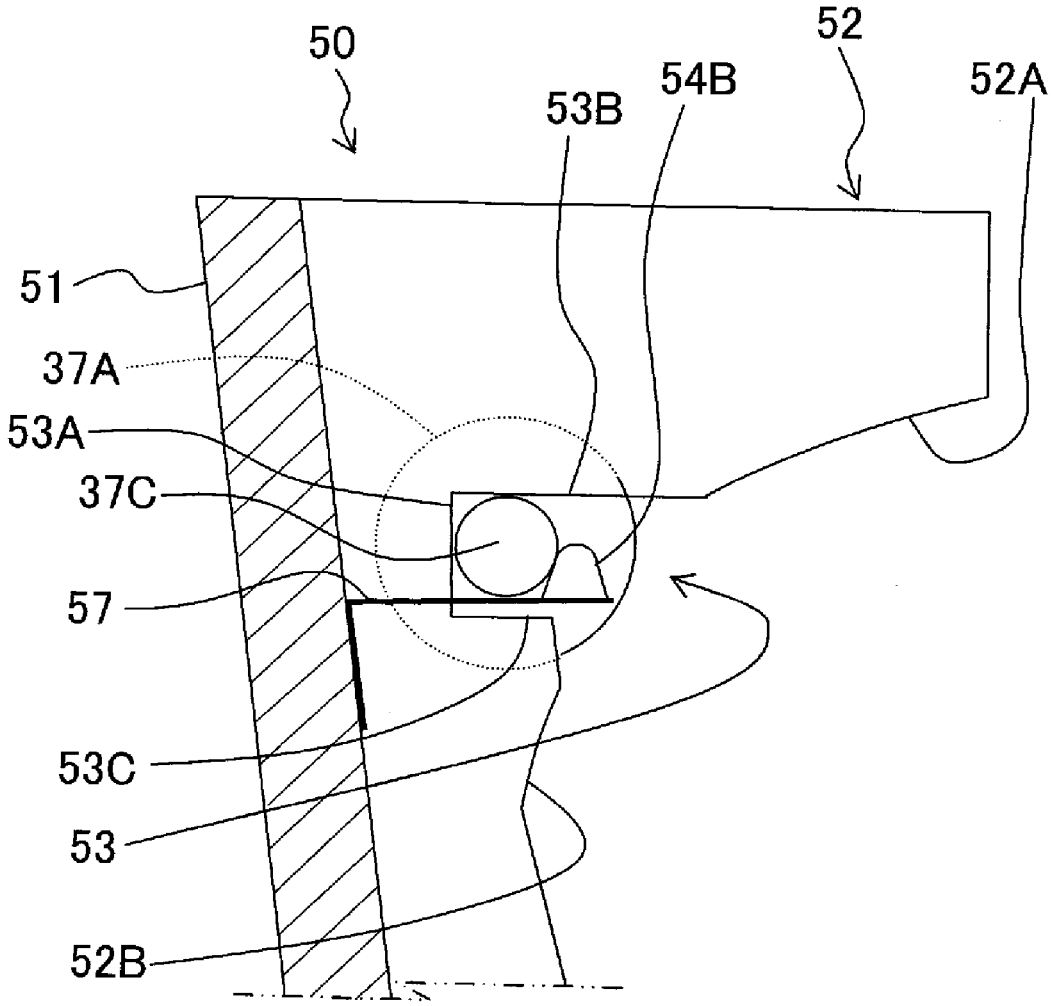
FIG. 8 is a cross-sectional view showing a movable member of a second modified embodiment.

In FIG. 8, the claw portion 54B is fixed to the other end of the plate spring 57 of which one end is fixed to the base portion 51 of the movable member 50, and is supported by the plate spring 57 to be movable in the vertical direction 7 in the first attitude, and also is biased upward in the first attitude.

The plate spring 57 and the claw portion 54B correspond to the deformable portion of the present teaching.

In the embodiment and the modified embodiments described above, the transporting medium 19 which is transported in a substantially vertical direction is directed in a substantially horizontal direction by the curved-line portion of the lower portion of the second portion 52B of the guide rib 52. However, the present invention is not restricted to such an arrangement. In the transporting unit according to the present teaching, it is possible to structure the transporting path so that the transporting medium which is transported in an arbitrary first direction, is directed in a second direction which differs from the first direction.

What is claimed is:

1. A transporting apparatus which transports a sheet shaped transporting medium, comprising:

a pair of transporting rollers which pinches the transporting medium to transport, including a drive roller and a driven roller which is driven by the drive roller;

a transporting path which is formed to have a curved portion which changes a transporting direction of the transporting medium transported by the pair of transporting rollers, and the pair of transporting rollers being arranged in the curved portion; and a movable member which is changeable to a first attitude and a second attitude, wherein under a condition that the movable member takes the first attitude, an outer side of the curved portion is defined by the movable member to guide the transporting medium, under a condition that the movable member takes the second attitude, the outer side of the curved portion is opened not to define the outer side of the curved portion, and the movable member includes a guiding portion which guides the transporting medium between the pair of transporting rollers under a condition that the movable member takes the first attitude, and a positioning portion which positions the guiding portion with respect to a shaft of the drive roller under a condition that the movable member takes the first attitude, and which is separated from the shaft of the drive roller under a condition that the movable member takes the second attitude.

2. The transporting apparatus according to claim 1, wherein the positioning portion includes a fitting portion which is detachable from the shaft of the drive roller, and a deformable portion which holds a state of the fitting portion and the shaft of the drive roller being fitted, and which is elastically deformable in a case of detaching the shaft of the drive roller from the fitting portion and in a case of fitting the shaft of the drive roller to the fitting portion, and the deformable portion is configured so that, under a condition that the movable member takes the first attitude, the deformable portion is engaged with the shaft from an up stream side of the transporting direction, and undergoes elastic deformation toward upstream side of the transporting direction.

3. The transporting apparatus according to claim 2, wherein the movable member includes a pivot shaft which is arranged at an opposite side of the shaft of the drive roller, sandwiching the deformable portion in the first attitude, and the movable member is pivoted between the first attitude and the second attitude with the pivot shaft as a center.

4. The transporting apparatus according to claim 2, wherein the pair of drive rollers includes a plurality of pairs of drive rollers, and the plurality of pairs of drive rollers is provided to the shaft of the drive roller, to be separated in an axial direction of the drive rollers, and the deformable portion is engaged with the shaft, at a position between adjacent drive rollers.

5. The transporting apparatus according to claim 1, wherein the drive roller is arranged at the outer side of the curved portion, and the driven roller is arranged at an inner side of the curved portion.

6. The transporting apparatus according to claim 1, wherein the guiding portion is a rib which is extended along the transporting direction in the first attitude.

7. The transporting apparatus according to claim 6, wherein the rib has a straight-line portion which is linearly extended in a first direction to guide the transporting medium under a condition that the movable member takes the first attitude, and a curved-line portion which defines the curved portion to direct the transporting medium guided in the first direction, in a second direction that is different from the first direction.

8. The transporting apparatus according to claim 7, wherein the first direction is substantially parallel to a vertical direction and the second direction is substantially parallel to a horizontal direction.

9. The transporting apparatus according to claim 7, wherein the positioning portion includes a fitting portion which is detachable from the shaft of the drive roller, and a deformable portion which holds a state of the fitting portion and the shaft of the drive roller being fitted, and which is elastically deformable in a case of detaching the shaft of the drive roller from the fitting portion and in a case of fitting the shaft of the drive roller to the fitting portion, the fitting portion is a notch formed in the curved-line portion, and the deformable portion is formed as an engaging member which is arranged in the curved-shaped portion, and which includes a base portion which is elastically deformable and which is extended toward the shaft of the drive roller, in the first attitude, and a claw portion which is formed at a front end of the base portion and which is to be engaged with the shaft of the drive roller in the first attitude.

10. The transporting apparatus according to claim 7, wherein the positioning portion includes a fitting portion which is detachable from the shaft of the drive roller, and a deformable portion which holds a state of the fitting portion and the shaft of the drive roller being fitted, and which is elastically deformable in a case of detaching the shaft of the drive roller from the fitting portion and in a case of fitting the shaft of the drive roller to the fitting portion, and the fitting portion and the deformable portion are formed integrally as a substantially C-shaped member which is arranged in the curved-line portion, and which has an inner diameter almost same as an outer diameter of the shaft of the drive roller.

11. A printer which jets an ink on to a sheet shaped recording medium to form an image, comprising:

a recording-medium supply section on which the recording medium is placed;

a recording head which jets the ink onto the recording medium; and the transporting apparatus as defined in claim 1, which transports the recording medium placed on the recording-medium supply section, toward the recording head.

* * * * *